US008087399B2

(12) United States Patent
Grandi et al.

(10) Patent No.: US 8,087,399 B2
(45) Date of Patent: Jan. 3, 2012

(54) FUEL INJECTION VALVE FOR INTERNAL COMBUSTION ENGINE

(75) Inventors: Mauro Grandi, Livorno (IT); Cédric Leger, Pisa (FR); Ileana Romeo, Grossetto (IT)

(73) Assignee: Continental Automotive GmbH, Hannover (DE)

( * ) Notice: Subject to any disclaimer, the term of this patent is extended or adjusted under 35 U.S.C. 154(b) by 324 days.

(21) Appl. No.: 12/556,963

(22) Filed: Sep. 10, 2009

(65) Prior Publication Data

US 2010/0071669 A1 Mar. 25, 2010

(30) Foreign Application Priority Data

Sep. 19, 2008 (EP) ..... 08016573

(51) Int. Cl.
*F02M 51/00* (2006.01)
*B05B 1/32* (2006.01)

(52) U.S. Cl. ..... 123/472; 239/585.5; 239/585.1

(58) Field of Classification Search ..... 123/472; 239/585.1–585.5

See application file for complete search history.

(56) References Cited

U.S. PATENT DOCUMENTS 5,625,946 A * 5/1997 Wildeson et al. ..... 29/888.41
5,875,972 A * 3/1999 Ren et al. ..... 239/463
6,257,508 B1 * 7/2001 Wieczorek et al. ..... 239/533.8
6,523,759 B1 2/2003 D'Arrigo
6,619,269 B1 * 9/2003 Stier et al. ..... 123/490
6,857,584 B2 * 2/2005 Sebastian et al. ..... 239/533.2
2010/0263631 A1 * 10/2010 Reiter ..... 123/472

FOREIGN PATENT DOCUMENTS

WO WO02/084102 A1 10/2002

OTHER PUBLICATIONS

European Search Report, Application No. 08016573.1-1263, 5 pages, Feb. 11, 2009.

* cited by examiner

*Primary Examiner* — Erick Solis
(74) *Attorney, Agent, or Firm* — King & Spalding L.L.P.

(57) ABSTRACT

An injection valve (62) has an injection body (38) with a first cavity (7), wherein a valve body (4) is at least partially disposed and wherein an armature collar (28) is axially movable. The valve body (4) has a second cavity (8), wherein a valve needle (10) is axially movable. An armature (12) is axially movable at least partially within the first cavity (7) and has a first cylindrical portion (32) and a second cylindrical portion (34), which is mechanically coupled to the valve needle (10). A coil assembly (40) is operable to magnetically actuate the armature (12) and the valve needle (10). The armature collar (28) partially takes in the second cylindrical portion (34). An armature collar spring (20) is adopted to supply the armature collar (28) with a spring load to push the armature collar (28) towards the first cylindrical portion (32).

12 Claims, 2 Drawing Sheets

FUEL INJECTION VALVE FOR INTERNAL COMBUSTION ENGINE

CROSS-REFERENCE TO RELATED APPLICATIONS

This application claims priority to EP Patent Application No. 08016573 filed Sep. 19, 2008, the contents of which is incorporated herein by reference in its entirety.

TECHNICAL FIELD

The invention relates to an injection valve.

BACKGROUND

Injection valves are in widespread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

U.S. Pat. No. 6,523,759 B1 discloses that during operation of the injection valve, a close action of the needle to prevent dosing of fluid into the intake manifold or into the combustion chamber is followed by an unwanted reopen and close phase of the needle, called needle bounce. During the unwanted reopen and close phase, unwanted fluid is dispensed from the injection valve, resulting in a degraded performance of the injection valve. Therefore, a flow restrictor is disposed in an armature of the needle to restrict fluid flow towards an upstream end of the armature, resulting in a reduced bouncing of the needle.

SUMMARY

According to various embodiments, an injection valve can be created which facilitates a reliable and precise function.

According to an embodiment, an injection valve may comprise an injector body with a central longitudinal axis and a first cavity, a valve body, being disposed at least partially within the first cavity and comprising a second cavity, a valve needle, being axially movable in the second cavity and preventing a fluid injection in a closing position and permitting the fluid injection in further positions, an armature, being axially movable at least partially within the first cavity and comprising a first cylindrical portion and a second cylindrical portion, an outer diameter of the first cylindrical portion being greater than an outer diameter of the second cylindrical portion, the second cylindrical portion being mechanically coupled to the valve needle, a coil assembly, comprising a bobbin that retains a coil and being operable to magnetically actuate the armature and the valve needle to move axially, an armature collar, being axially movable in the first cavity and being cylindrically shaped with a third cavity, which partially takes in the second cylindrical portion of the armature, an outer diameter of the armature collar being basically equal to the outer diameter of the first cylindrical portion of the armature, and an armature collar spring, being preloaded and being adopted to supply the armature collar with a spring load to push the armature collar towards the first cylindrical portion of the armature.

According to a further embodiment, the armature collar spring may be disposed around the second cylindrical portion of the armature and rests on a spring seat formed by one end of the valve body associated to the armature collar, and wherein the armature collar forms a further seat of the armature collar spring.

According to a further embodiment, the valve body may comprise a valve needle seat, with the armature collar being adopted to and arranged for limiting a bouncing of the valve needle after the valve needle impacts the valve needle seat in the closing position. According to a further embodiment, the armature may comprise a recess, being hydraulically connected with the second cavity of the valve body and taking in a flow restrictor, being operable to restrict a fluid flow from the second cavity into the recess.

BRIEF DESCRIPTION OF THE DRAWINGS

Exemplary embodiments are explained in the following with the aid of schematic drawings. These are as follows.

Elements of the same design and function that appear in different illustrations are identified by the same reference character.

DETAILED DESCRIPTION

Figure 1:
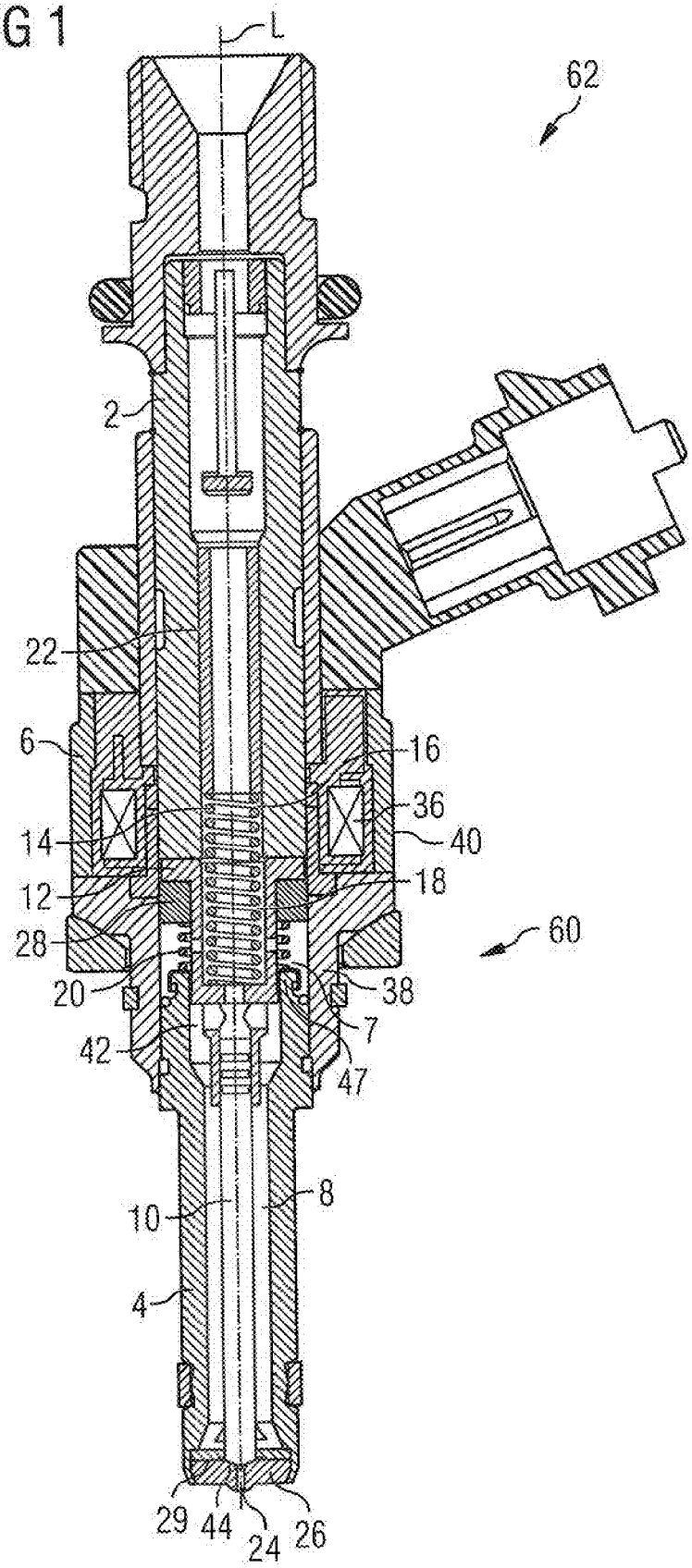
FIG. 1 an injection valve with a valve assembly in a longitudinal section view, FIG. 2 section of the injection valve according to FIG. 1 in a longitudinal section view.

According to various embodiments, an injection valve may comprise an injector body with a central longitudinal axis and a first cavity, wherein a valve body is at least partially disposed. The valve body comprises a second cavity, wherein a valve needle is axially movable. The valve needle prevents a fluid injection in a closing position and permits the fluid injection in further positions. An armature is axially movable at least partially within the first cavity and comprises a first and a second cylindrical portion. An outer diameter of the first cylindrical portion is greater than an outer diameter of the second cylindrical portion. The second cylindrical portion is mechanically coupled to the valve needle. Furthermore, the injection valve comprises a coil assembly. The coil assembly comprises a bobbin that retains a coil and is operable to magnetically actuate the armature and the valve needle to move axially. An armature collar is axially movable in the first cavity and is cylindrically shaped with a third cavity. The third cavity partially takes in the second cylindrical portion of the armature. An outer diameter of the armature collar is basically equal to the outer diameter of the first cylindrical portion of the armature. The injection valve further comprises an armature collar spring, being preloaded and being adopted to supply the armature collar with a spring load to push the armature collar towards the first cylindrical portion of the armature. The advantage is that a bouncing of the valve needle can be at least significantly reduced so that the injection valve facilitates a reliable and precise function. While the armature and the valve needle are magnetically actuated by the coil assembly, the armature collar is magnetically coupled to the armature, preferably the first cylindrical portion of the armature, and forms a magnetic circuit with the coil assembly. While the armature and the valve needle are not actuated by the coil assembly, the valve needle moves towards a valve needle seat of the valve body in its closing position. While the valve needle moves towards the valve needle seat, the kinetic energy of the armature collar is at least partially dissipated by the armature collar spring. This results in a reduction of the kinetic energy of the valve needle and armature and therefore contributes to limited, in particular basically no, bouncing of the valve needle after impacting the valve needle seat. Additionally, an anti-friction coating of the valve needle in the contact area of the valve needle and the valve needle seat may be omitted or at least reduced, thus ensuring a long operation period of the injection valve.

In a further embodiment, the armature collar spring is disposed around the second cylindrical portion of the armature and rests on a spring seat formed by one end of the valve body associated to the armature collar, with the armature collar forming a further seat of the armature collar spring. This has the advantage that the armature collar spring is arranged for dissipating the kinetic energy of the armature collar. This ensures a reduced kinetic energy of the valve needle and the armature.

In yet a further embodiment, the valve body comprises a valve needle seat. The armature collar is adopted to and arranged for limiting the bouncing of the valve needle after the valve needle impacts the valve needle seat in the closing position. In particular, when the valve needle moves towards its closing position, one or more subsequent reopen and close phases of the valve needle results in a low performance of the injection valve. By limiting, in particular stopping, the bouncing of the valve needle shortly after the valve needle impacts the valve needle seat, the performance of the injection valve can be significantly improved.

In yet a further embodiment, the armature comprises a recess, being hydraulically connected with the second cavity of the valve body. The recess takes in a flow restrictor, being operable to restrict a fluid flow from the second cavity into the recess. By using the flow restrictor additionally besides the armature collar, the bouncing of the valve needle can be limited, in particular stopped, thus resulting in a reliable and precise function of the injection valve.

An injection valve 62 (FIG. 1), that is in particular suitable for dosing fuel to an internal combustion engine, comprises an inlet tube 2, a housing 6 and a valve assembly 60.

The valve assembly 60 comprises an injector body 38, which is for example part of the housing 6, with a central longitudinal axis L and a first cavity 7. The valve assembly 60 further comprises a valve body 4, which is at least partially disposed within the first cavity 7 of the injector body 38. The valve body 4 takes in a valve needle 10. In the inlet tube 2, a recess 16 is provided which further extends to a recess 18 of an armature 12. The armature 12 consists of a first and a second cylindrical portion 32, 34. An outer diameter of the first cylindrical portion 32 is greater than an outer diameter of the second cylindrical portion 34. The second cylindrical portion 34 is mechanically coupled to the valve needle 10. An armature collar 28 is cylindrically shaped with a third cavity 45. The third cavity 45 at least partially takes in the second cylindrical portion 34. The armature collar 28 is axially movable along the second cylindrical portion 34 of the armature 12 and an outer diameter of the armature collar 28 is basically equal to the outer diameter of the first cylindrical portion 32 of the armature 12. An armature collar spring 20, for example a helical spring, is disposed around the second cylindrical portion 34 of the armature 12 and rests on a spring seat formed by an armature guide 30 disposed at an upper end of the valve body 4, which is associated to the armature collar 28. One side of the armature collar 28, which is not associated to the first cylindrical portion 32 of the armature 12, forms a further seat of the armature collar spring 20. The armature collar spring 20 is preferably preloaded and is adopted to supply the armature collar 28 with a spring load to push the armature collar 28 towards the first cylindrical portion 32 of the armature 12. The recess 16 of the inlet tube 2 and/or the recess 18 of the armature 12 take in a bias spring 14. Preferably, the bias spring 14 rests on a spring seat being formed by a fluid restrictor, for example an anti-bounce disc, or being formed by a projection within the recess 18 of the armature 12. By this, the bias spring 14 is mechanically coupled to the valve needle 10. An adjusting tube 22 is provided in the recess 16 of the inlet tube 2. The adjusting tube 22 forms a further seat for the spring 14 and may be axially moved during the manufacturing process of the injection valve 62 in order to preload the bias spring 14 in a desired way.

In a closing position of the valve needle 10, it sealingly rests on a valve needle seat 26, by this preventing a fluid flow through at least one injection nozzle 24. The injection nozzle 24 may be, for example, an injection hole. However, it may also be of some other type suitable for dosing fluid. The valve needle seat 26 may be made in one part with the valve body 4 or a separate part from the valve body 4. In addition to that, a lower guide 29 for guiding the valve needle 10 is provided. The lower guide 29 further comprises an orifice for guiding the fluid flow.

A fluid inlet portion 42 is provided in the valve body 4 which communicates with a fluid outlet portion 44 which is a part of the second cavity 8 near the valve needle seat 26.

The injection valve 62 is provided with a coil assembly 40 acting as an actuator unit, that comprises an electromagnetic actuator. The coil assembly 40 comprises a bobbin that retains a coil 36, which is preferably overmolded. The injector body 38, the armature 12, the armature collar 28 and the inlet tube 2 are forming a magnetic circuit.

The armature 12 is guided in the armature guide 30 and is supplied with a magnetic force if the coil assembly 40 is actuated, thus resulting in an axial movement of the armature 12 and with the valve needle 10 acting against a spring load of the bias spring 14.

Figure 2:
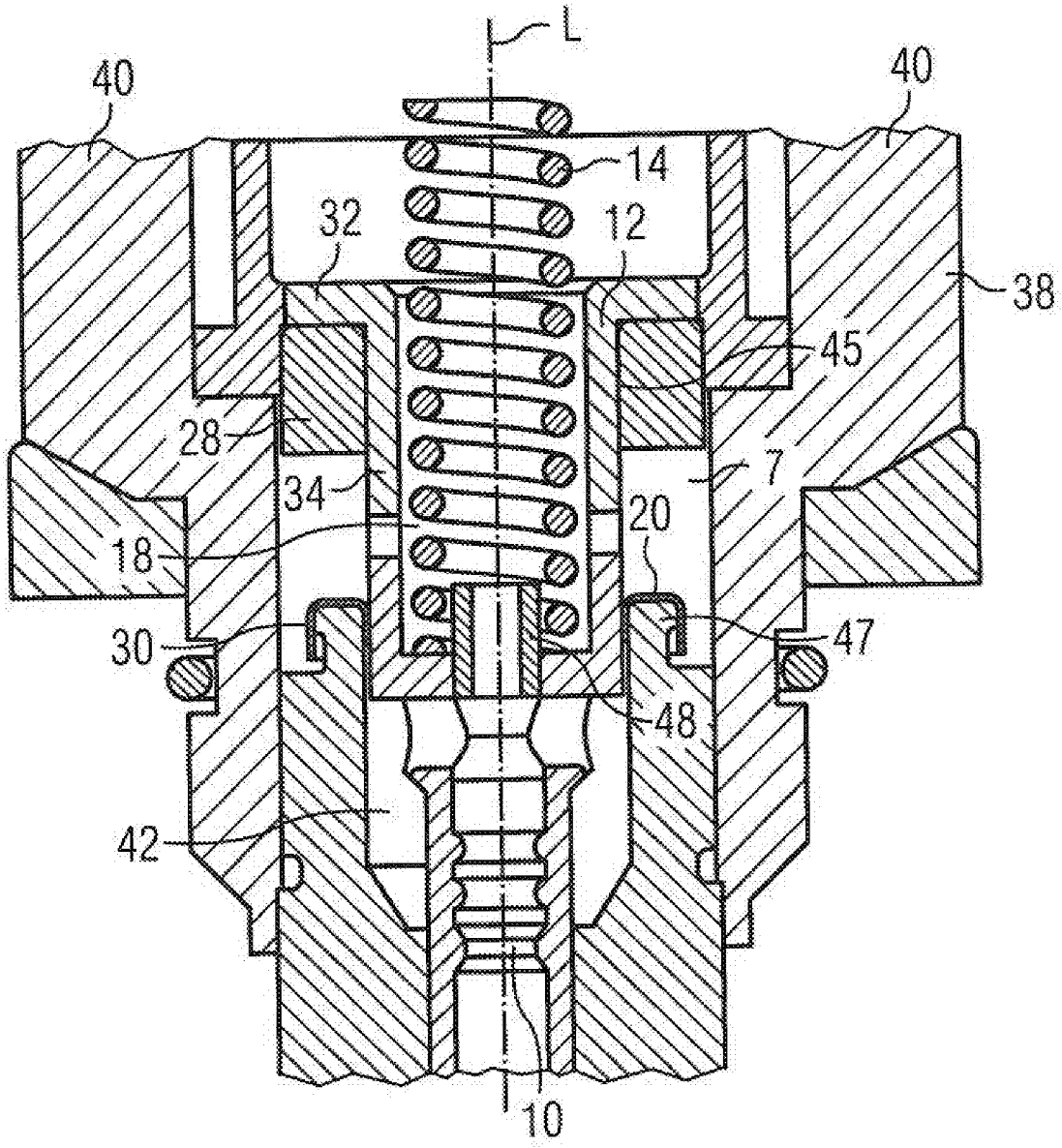

FIG. 2 depicts a section of the injection valve 62 according to FIG. 1 in a longitudinal section view. The section depicts the armature 12 axially movable at least partially within the first cavity 7 of the injector body 38. The armature 12 comprises the first and the second cylindrical portion 32, 34. If the armature 12 and the valve needle 10 are actuated by the coil assembly 40, the first cylindrical portion 32, the armature 28 and the coil assembly 40 form the magnetic circuit moving the armature 12, the armature collar 28 and the valve needle 10 axially to act against the spring load of the bias spring 14 to open the injection valve 62 for injecting fluid. While actuated by the coil assembly 40 the armature collar 28 is magnetically coupled to the armature 12.

After actuating the armature 12 and the valve needle 10 by the coil assembly 40, the armature 12, the armature collar 28 and the valve needle 10 are moving axially towards the valve needle seat 26 of the valve body 4, driven by the spring load of the bias spring 14. If the valve needle 10 impacts the valve needle seat 26, the armature collar 28 decouples from the first cylindrical portion 32 of the armature 12, thus draining a kinetic energy of the armature collar 28 as deformation energy to the armature collar spring 20. A remaining kinetic energy, associated to the armature 12 and the valve needle 10, is reduced, so that shortly after the valve needle 10 impacts the valve needle seat 26 the bouncing of the valve needle 10 is limited, in particular stopped. Preferably, the armature collar spring 20 is adopted to absorb the kinetic energy of the armature collar 28, so that the armature collar 28 is not hitting the armature 12 heavily after moving backwards due to the spring load of the armature collar spring 20. This can be achieved by using an armature collar spring 20 with a low spring rate, for example 0.1 to 0.2 N/m. By this, one or more reopen and close phases of the valve needle 10 can be ideally avoided.

The recess 18 of the armature 12 is hydraulically connected with the second cavity 8 of the valve body 4 via fluid inlet portion 42. The recess 18 takes in a fluid restrictor 48 being shaped to restrict a fluid flow from the fluid inlet portion 42 into the recess 18 of the armature 12, thus limiting, in particular stopping, the bouncing of the valve needle 10 additionally to the use of the armature collar 28.

What is claimed is:

1. An injection valve, comprising:

an injector body with a central longitudinal axis and a first cavity, a valve body, being disposed at least partially within the first cavity and comprising a second cavity, a valve needle, being axially movable in the second cavity and preventing a fluid injection in a closing position and permitting the fluid injection in further positions, an armature, being axially movable at least partially within the first cavity and comprising a first cylindrical portion and a second cylindrical portion, an outer diameter of the first cylindrical portion being greater than an outer diameter of the second cylindrical portion, the second cylindrical portion being mechanically coupled to the valve needle, a coil assembly, comprising a bobbin that retains a coil and being operable to magnetically actuate the armature and the valve needle to move axially, an armature collar, being axially movable in the first cavity and being cylindrically shaped with a third cavity, which partially takes in the second cylindrical portion of the armature, an outer diameter of the armature collar being basically equal to the outer diameter of the first cylindrical portion of the armature, an armature collar spring, being preloaded and being adopted to supply the armature collar with a spring load to push the armature collar towards the first cylindrical portion of the armature.

2. The injection valve according to claim 1, wherein the armature collar spring is disposed around the second cylindrical portion of the armature and rests on a spring seat formed by one end of the valve body associated to the armature collar, and wherein the armature collar forms a further seat of the armature collar spring.

3. The injection valve according to claim 1, wherein the valve body comprises a valve needle seat, with the armature collar being adopted to and arranged for limiting a bouncing of the valve needle after the valve needle impacts the valve needle seat in the closing position.

4. The injection valve according to claim 1, wherein the armature comprises a recess, being hydraulically connected with the second cavity of the valve body and taking in a flow restrictor, being operable to restrict a fluid flow from the second cavity into the recess.

5. An method of operating an injection valve, comprising the steps of:

providing an injector body with a central longitudinal axis and a first cavity, disposing a valve body having a second cavity at least partially within the first cavity, preventing a fluid injection by closing a valve needle which is axially movable in the second cavity and permitting the fluid injection in further positions, arranging an armature, being axially movable at least partially within the first cavity and comprising a first cylindrical portion and a second cylindrical portion, an outer diameter of the first cylindrical portion being greater than an outer diameter of the second cylindrical portion, and mechanically coupling the second cylindrical portion to the valve needle, providing a coil assembly, comprising a bobbin that retains a coil and being operable to magnetically actuate the armature and the valve needle to move axially, providing an armature collar, being axially movable in the first cavity and being cylindrically shaped with a third cavity, which partially takes in the second cylindrical portion of the armature, an outer diameter of the armature collar being basically equal to the outer diameter of the first cylindrical portion of the armature, and preloading an armature collar spring being adopted to supply the armature collar with a spring load to push the armature collar towards the first cylindrical portion of the armature.

6. The method according to claim 5, further comprising the step of disposing the armature collar spring around the second cylindrical portion of the armature such that the armature collar spring rests on a spring seat formed by one end of the valve body associated to the armature collar, wherein the armature collar forms a further seat of the armature collar spring.

7. The method according to claim 5, wherein the valve body comprises a valve needle seat, with the armature collar being adopted to and arranged for limiting a bouncing of the valve needle after the valve needle impacts the valve needle seat in the closing position.

8. The method according to claim 5, wherein the armature comprises a recess, being hydraulically connected with the second cavity of the valve body and taking in a flow restrictor, being operable to restrict a fluid flow from the second cavity into the recess.

9. An internal combustion engine comprising an injection valve comprising:

an injector body with a central longitudinal axis and a first cavity, a valve body, being disposed at least partially within the first cavity and comprising a second cavity, a valve needle, being axially movable in the second cavity and preventing a fluid injection in a closing position and permitting the fluid injection in further positions, an armature, being axially movable at least partially within the first cavity and comprising a first cylindrical portion and a second cylindrical portion, an outer diameter of the first cylindrical portion being greater than an outer diameter of the second cylindrical portion, the second cylindrical portion being mechanically coupled to the valve needle, a coil assembly, comprising a bobbin that retains a coil and being operable to magnetically actuate the armature and the valve needle to move axially, an armature collar, being axially movable in the first cavity and being cylindrically shaped with a third cavity, which partially takes in the second cylindrical portion of the armature, an outer diameter of the armature collar being basically equal to the outer diameter of the first cylindrical portion of the armature, an armature collar spring, being preloaded and being adopted to supply the armature collar with a spring load to push the armature collar towards the first cylindrical portion of the armature.

10. The internal combustion engine according to claim 9, wherein the armature collar spring is disposed around the second cylindrical portion of the armature and rests on a spring seat formed by one end of the valve body associated to the armature collar, and wherein the armature collar forms a further seat of the armature collar spring.

11. The internal combustion engine according to claim 9, wherein the valve body comprises a valve needle seat, with the armature collar being adopted to and arranged for limiting a bouncing of the valve needle after the valve needle impacts the valve needle seat in the closing position.

12. The internal combustion engine according to claim 9, wherein the armature comprises a recess, being hydraulically connected with the second cavity of the valve body and taking in a flow restrictor, being operable to restrict a fluid flow from the second cavity into the recess.

* * * * *